US009024217B2

(12) United States Patent
Khor

(10) Patent No.: US 9,024,217 B2
(45) Date of Patent: May 5, 2015

(54) KEY STRUCTURE OF KEYBOARD

(71) Applicant: Primax Electronics Ltd., Neihu, Taipei (TW)

(72) Inventor: Chin-Siong Khor, Taipei (TW)

(73) Assignee: Primax Electronics Ltd., Neihu (TW)

( * ) Notice: Subject to any disclaimer, the term of this patent is extended or adjusted under 35 U.S.C. 154(b) by 274 days.

(21) Appl. No.: 13/659,685

(22) Filed: Oct. 24, 2012

(65) Prior Publication Data

US 2014/0110234 A1 Apr. 24, 2014

(51) Int. Cl.
*H01H 13/14* (2006.01)
*H01H 3/12* (2006.01)
*H01H 13/705* (2006.01)

(52) U.S. Cl.
CPC ..... *H01H 3/125* (2013.01); *H01H 13/705* (2013.01)

(58) Field of Classification Search
CPC ..... H01H 13/70; H01H 13/88; H01H 13/14
USPC ..... 200/341–345, 511–517, 5 A; 345/168–170; 400/490–496
See application file for complete search history.

(56) References Cited

U.S. PATENT DOCUMENTS 7,385,149 B2 * 6/2008 Liu ..... 200/5 A
8,247,714 B2 * 8/2012 Tsai ..... 200/5 A

* cited by examiner

*Primary Examiner* — Amy Cohen Johnson
*Assistant Examiner* — Marina Fishman
(74) *Attorney, Agent, or Firm* — Kirton McConkie; Evan R. Witt

(57) ABSTRACT

A key structure of a keyboard includes an intermediate plate, a keycap, a scissors-type connecting member, and an elastic element. The intermediate plate includes a hollow portion and a position-limiting recess. The position-limiting recess is formed in a lower part of the intermediate plate and in communication with the hollow portion. A lower part of the scissors-type connecting member is accommodated within the position-limiting recess. An upper part of the scissors-type connecting member is engaged with the keycap. After the elastic element is fixed on the intermediate plate, the elastic element is penetrated through the scissors-type connecting member and contacted with the keycap. The intermediate plate, the keycap, the scissors-type connecting member and the elastic element are combined as a single key. After plural keys are fixed on a base plate, the keyboard is assembled. Consequently, the efficiency of assembling the keyboard is enhanced.

11 Claims, 5 Drawing Sheets

KEY STRUCTURE OF KEYBOARD

FIELD OF THE INVENTION

The present invention relates to a key structure, and more particularly to a key structure of a keyboard.

BACKGROUND OF THE INVENTION

Nowadays, consumer electronic products have experienced great growth and are now rapidly gaining in popularity. Especially, notebook computers have become dispensable electronic products of the office workers.

The notebook computer comprises a keyboard with plural key structures. Generally, a key structure of the keyboard of the notebook computer mainly comprises a scissors-type connecting member, an elastic element, and a keycap. The elastic element is disposed within the scissors-type connecting member. The keycap is disposed over the scissors-type connecting member and the elastic element. After the plural key structures are fixed on a base plate, the keyboard is assembled. In the conventional keyboard, plural recesses or plural hooks for installing the scissors-type connecting member are directly formed on the base plate by an impact molding process. After the scissors-type connecting member is engaged with the recesses or the hooks of the base plate, the scissors-type connecting member is installed on the base plate.

However, the conventional keyboard still has some drawbacks. For example, as previously described, the recesses or the hooks to be engaged with the scissors-type connecting member are directly formed on the base plate by the impact molding process. As known, the impact molding process is complicated and costly. In addition, the way of installing the scissors-type connecting member is not user-friendly. Moreover, if the hooks are damaged, the base plate fails to be effectively used, which may result in waste of resources.

For solving the above drawbacks, another keyboard is disclosed. FIG. 1 is a schematic exploded view illustrating a conventional keyboard. As shown in FIG. 1, the conventional keyboard 1 comprises a base plate 10, a flexible circuit board 11, a scissors-type connecting member 12, a keycap 13, and an intermediate plate 14. The intermediate plate 14 comprises at least one first engaging recess 15 and at least one second engaging recess 17. The first engaging recess 15 is arranged between two first protrusion blocks 16. The second engaging recess 17 is disposed under a second protrusion block 18.

For assembling the conventional keyboard 1, the flexible circuit board 11 is firstly fixed on a top surface of the intermediate plate 14, so that the intermediate plate 14 is fixed on the base plate 10. Then, plural scissors-type connecting members 12 are fixed on the intermediate plate 14 and sequentially connected with plural keycaps 13, respectively.

Moreover, the scissors-type connecting member 12 comprises an inner frame 121 and an outer frame 123. A position-limiting post 122 at a lower part of the inner frame 121 is accommodated within the second engaging recess 17. A position-limiting post 124 at a lower part of the outer frame 123 is accommodated within the first engaging recess 15. A position-limiting post 125 at an upper part of the inner frame 121 and a position-limiting post 126 at an upper part of the outer frame 123 are connected with the keycap 13 over the intermediate plate 14. Consequently, the scissors-type connecting member 12 is fixed between the keycap 13 and the intermediate plate 14.

Although the key structure of the conventional keyboard 1 as shown in FIG. 1 can be installed more conveniently, there are still some drawbacks. For example, after the key structure is installed and fixed, it is difficult to detach the scissors-type connecting member 12 from the intermediate plate 14. In other words, the way of replacing the key structure is very difficult.

Moreover, the intermediate plate 14 of the conventional keyboard 1 is not dependent on the number of the keycaps 13. That is, the size of the intermediate plate 14 does not match the size of the keycap 13. On the other words, the intermediate plate 14 is a one-piece structure matching the size of the base plate 10. In a case that any protrusion block of the one-piece intermediate plate 14 is damaged, the whole intermediate plate 14 fails to be continuously utilized, which may result in waste of resources. In addition, the quality of the key structure of the conventional keyboard 1 is still unsatisfied.

Therefore, there is a need of providing an improved key structure of a keyboard in order to eliminate the above drawbacks.

SUMMARY OF THE INVENTION

The present invention provides a key structure of a keyboard, in which the key structure is easily assembled and disassembled in order to facilitate replacement.

In accordance with an aspect of the present invention, there is provided a key structure of a keyboard. The key structure includes an intermediate plate, a keycap, a scissors-type connecting member, and an elastic element. The intermediate plate includes a hollow portion and a position-limiting recess. The position-limiting recess is located near a corner of the hollow portion. The keycap is disposed over the intermediate plate, and includes a hooking part. The hooking part is located at a lower part of the keycap. The scissors-type connecting member is arranged between the intermediate plate and the keycap. The scissors-type connecting member includes a lower position-limiting post group and an upper position-limiting post group. The lower position-limiting post group is accommodated within the position-limiting recess of the intermediate plate. The upper position-limiting post group is accommodated within the hooking part of the keycap. The elastic element fixed on the intermediate plate, penetrated through the scissors-type connecting member, and contacted with the lower part of the keycap.

In an embodiment, the keyboard further includes a base plate for supporting plural key structures, wherein the intermediate plate is fixed on the base plate.

In an embodiment, the intermediate plate further includes a protrusion post. The protrusion post is protruded from a lower part of the intermediate plate. In addition, the protrusion post is perpendicular to the lower part of the intermediate plate.

In an embodiment, a perforation corresponding to the protrusion post of the intermediate plate is formed in a top surface of the base plate. A tapered slot is formed in a bottom surface of the base plate. The perforation and the tapered slot are in communication with each other and collaboratively defined as a trumpet-shaped positioning hole. The protrusion post of the intermediate plate is embedded within the perforation and fixed on the base plate by a heat melt process.

In an embodiment, the position-limiting recess is formed in a lower part of the intermediate plate, and the position-limiting recess is in communication with the hollow portion.

In an embodiment, the scissors-type connecting member includes an outer frame and an inner frame pivotally coupled with the outer frame. The lower position-limiting post group includes two lower position-limiting posts, which are respectively protruded from a lower part of the outer frame and a lower part of the inner frame. The upper position-limiting post group includes two upper position-limiting posts, which are respectively protruded from an upper part of the outer frame and an upper part of the inner frame.

In an embodiment, the lower position-limiting post protruded from the lower part of the outer frame has a first planar surface, and the lower position-limiting post protruded from the lower part of the inner frame has a second planar surface and a guiding surface. The guiding surface is inclined to an edge of the second planar surface. The two upper position-limiting posts are both cylindrical posts.

In an embodiment, the keycap further includes a receiving space, which is formed in the lower part of the keycap. The hooking part is disposed within the receiving space. The hooking part includes a first hook and a second hook.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a key structure of a keyboard. For clarification and brevity, only the portion of the base plate directly under a key structure is shown in the following drawings. It is noted that the size and shape of the base plate are not restricted to the drawings.

Figure 1:
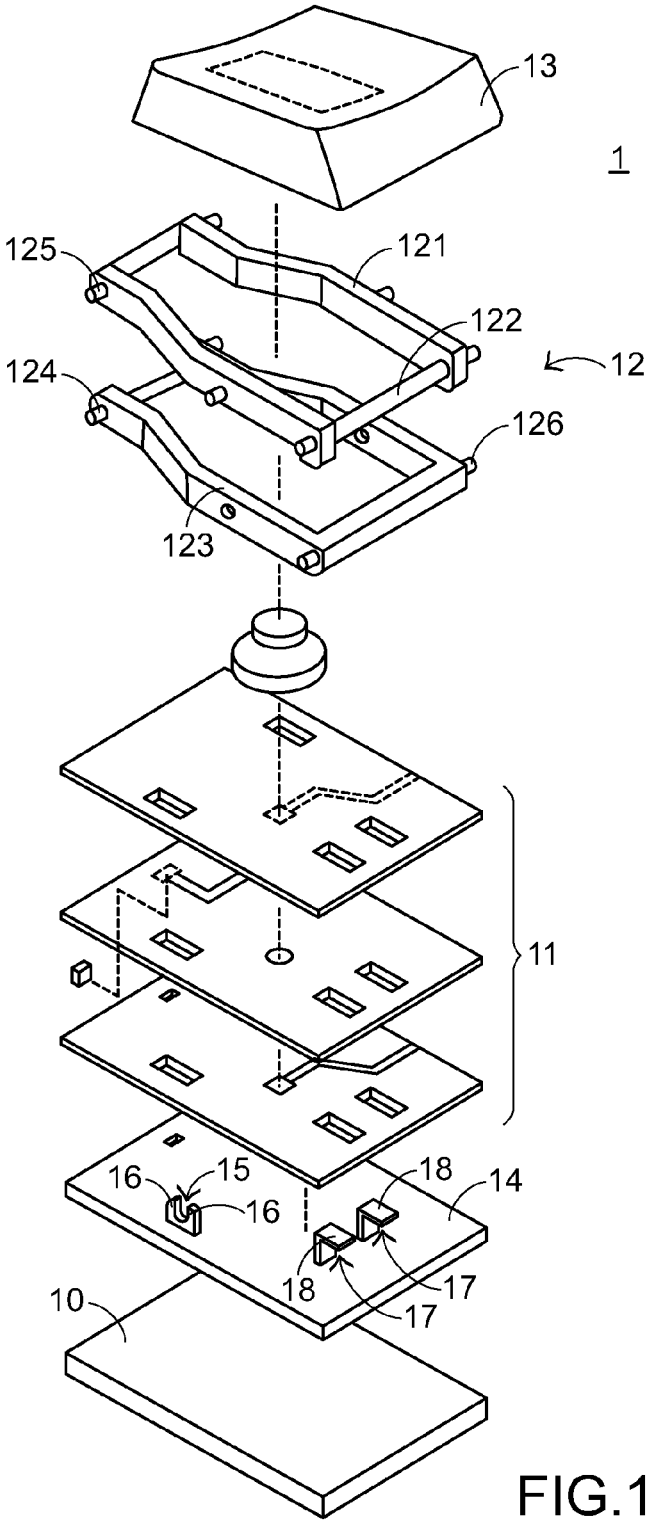
FIG.1 PRIOR ART
FIG. 1 is a schematic exploded view illustrating a conventional keyboard.
Figure 2:
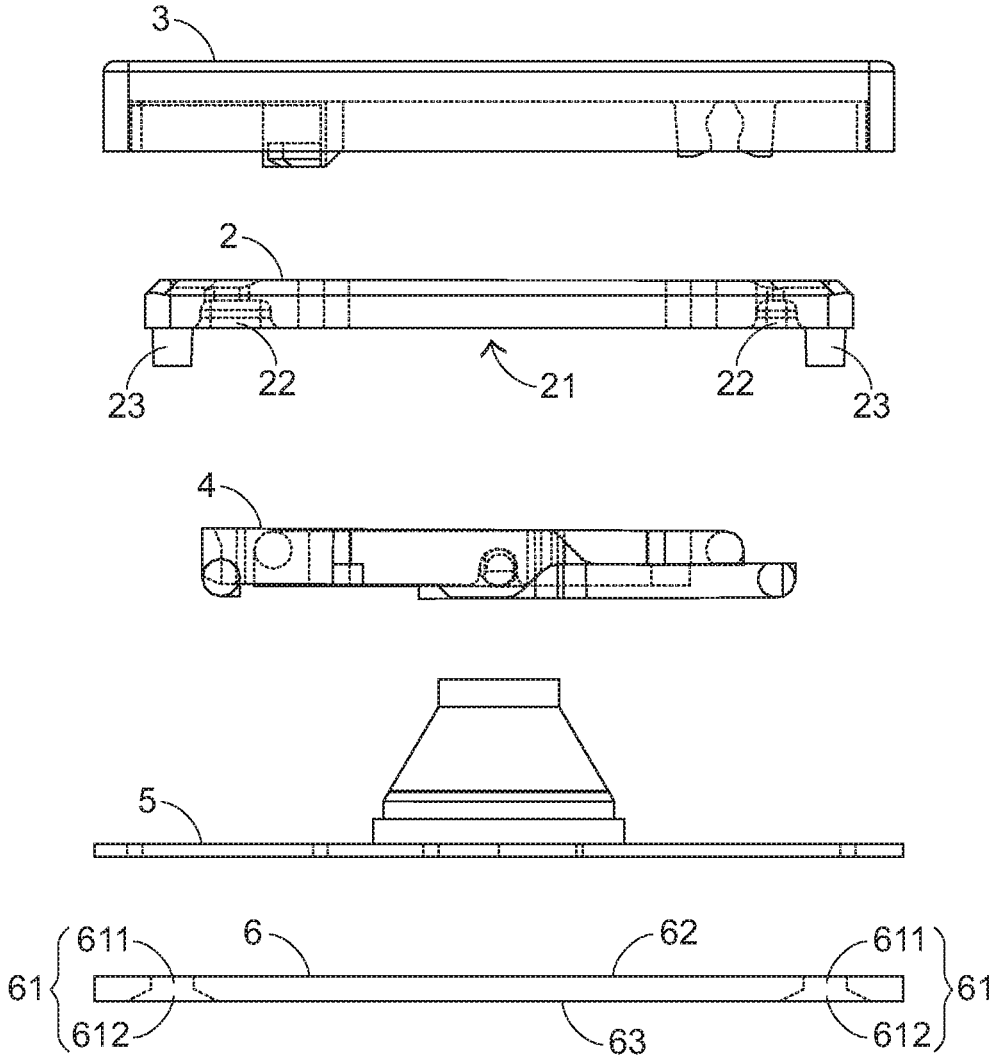
FIG. 2 is a schematic exploded view illustrating a keyboard according to an embodiment of the present invention.
Figure 3:
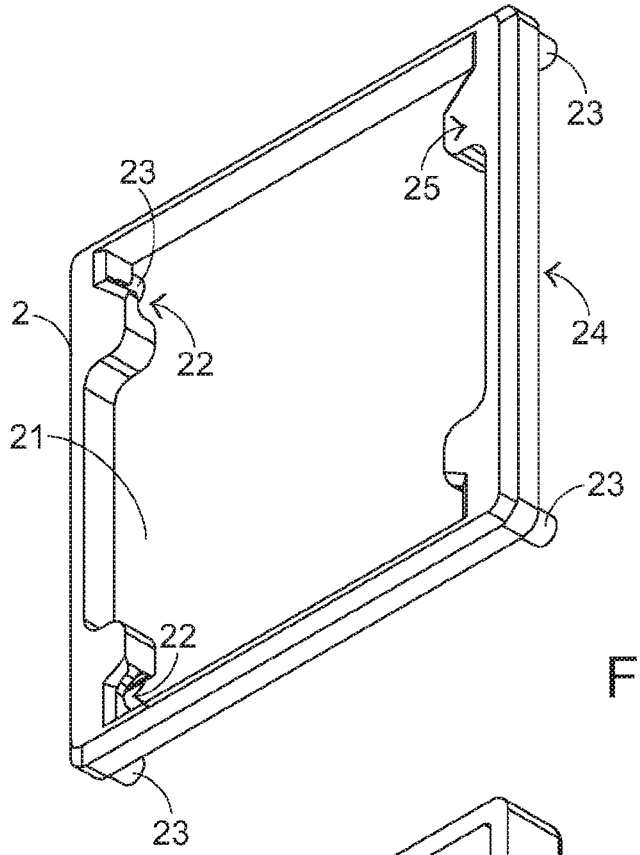
FIG. 3 is a schematic perspective view illustrating an intermediate plate of a key structure of a keyboard according to an embodiment of the present invention.
Figure 4:
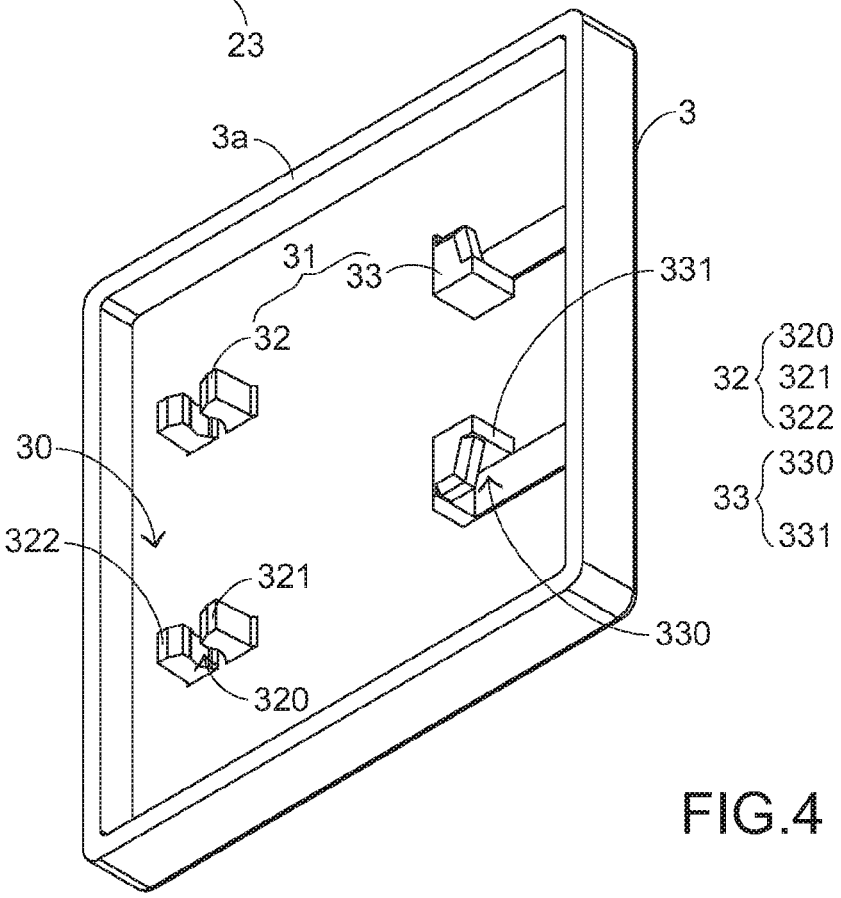
FIG. 4 is a schematic perspective view illustrating a keycap of a key structure of a keyboard according to an embodiment of the present invention.
Figure 5:
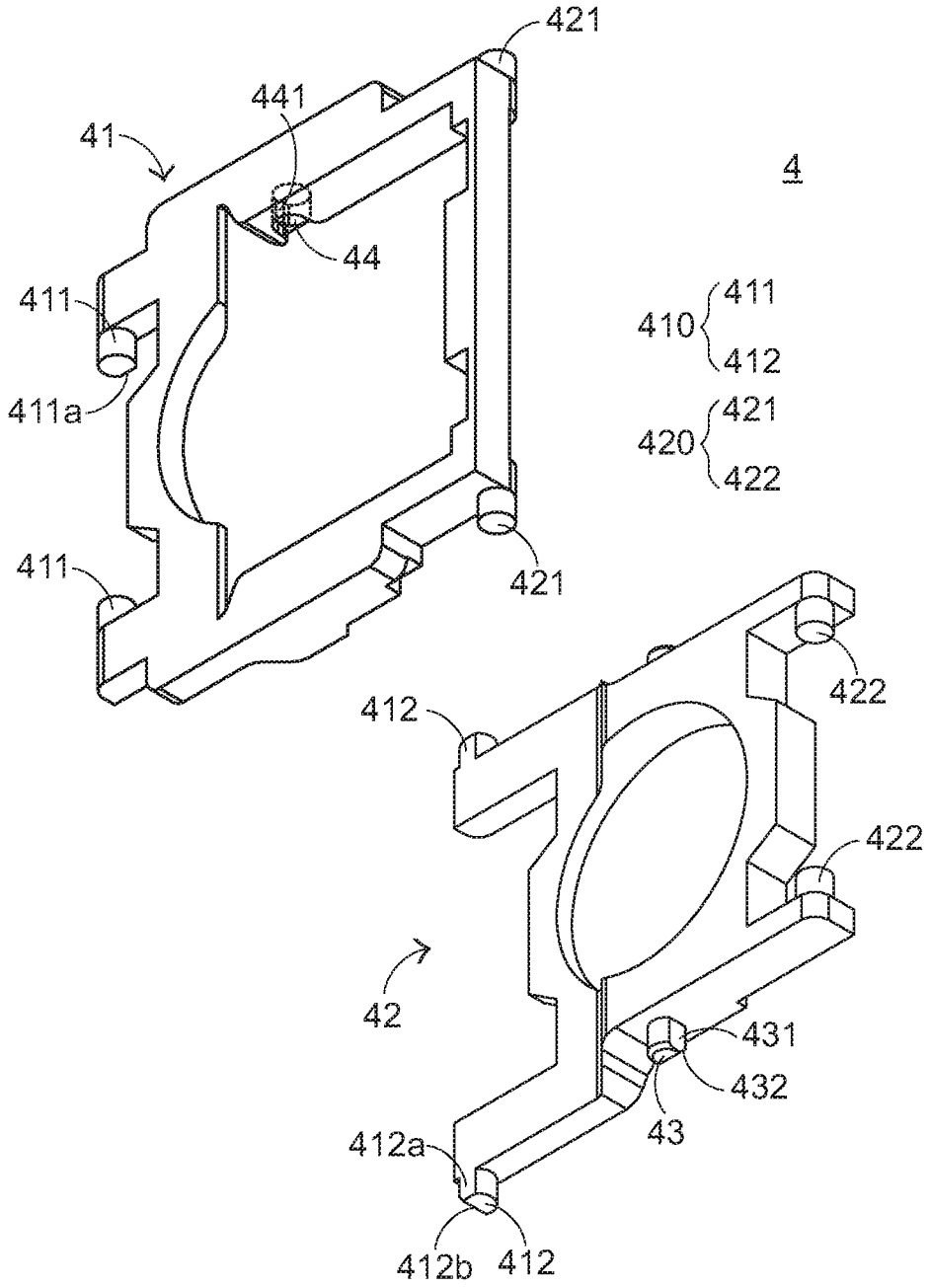
FIG. 5 is a schematic exploded view illustrating a scissors-type connecting member of a key structure of a keyboard according to an embodiment of the present invention.

Hereinafter, the configurations of a keyboard according to an embodiment of the present invention will be illustrated with reference to FIGS. 2-5. FIG. 2 is a schematic exploded view illustrating a keyboard according to an embodiment of the present invention. FIG. 3 is a schematic perspective view illustrating an intermediate plate of a key structure of a keyboard according to an embodiment of the present invention. FIG. 4 is a schematic perspective view illustrating a keycap of a key structure of a keyboard according to an embodiment of the present invention. FIG. 5 is a schematic exploded view illustrating a scissors-type connecting member of a key structure of a keyboard according to an embodiment of the present invention.

First of all, the components of a key structure of the keyboard will be illustrated. The key structure of the keyboard comprises an intermediate plate 2, a keycap 3, a scissors-type connecting member 4, and an elastic element 5. It is noted that each key structure comprises an independent intermediate plate 2. In a case that the keyboard has plural key structures, the number of the keycaps 3, the number of the scissors-type connecting members 4 and the number of the elastic elements 5 are equal to the number of the intermediate plates 2.

After the plural key structures are combined with a base plate 6, the keyboard is assembled.

The detailed structures of the intermediate plate 2, the keycap 3, the scissors-type connecting member 4, the elastic element 5 and the base plate 6 will be illustrated as follows.

As shown in FIG. 2, the base plate 6 comprises plural perforations 611 and plural tapered slots 612. The perforations 611 runs through a top surface 62 of the base plate 6. The tapered slots 612 runs through a bottom surface 63 of the base plate 6. In addition, the perforations 611 are in communication with the underlying tapered slots 612, respectively. Consequently, the perforations 611 and the corresponding tapered slots 612 are defined as respective positioning holes 61. As shown in FIG. 2, the positioning holes 61 are trumpet-shaped.

As shown in FIG. 3, the intermediate plate 2 comprises a hollow portion 21, four position-limiting recesses 22, and four protrusion posts 23. In FIG. 3, only two position-limiting recesses 22 at a first side of the intermediate plate 2 are shown, but the other two position-limiting recesses 22 at a second side of the intermediate plate 2 are not shown.

The hollow portion 21 is formed in a center of the intermediate plate 2. The four position-limiting recesses 22 are formed in a lower part 24 of the intermediate plate 2. In addition, the four position-limiting recesses 22 are located at the positions near four corners of the hollow portion 21, respectively. All of the four position-limiting recesses 22 are in communication with the hollow portion 21. The four protrusion posts 23 are protruded from the four corners of the lower part 24 of the intermediate plate 2, respectively. Moreover, the four protrusion posts 23 are perpendicular to the lower part 24 of the intermediate plate 2. In this embodiment, the intermediate plate 2 is made of a plastic material.

As shown in FIG. 4, the keycap 3 comprises a receiving space 30 and two hooking parts 31. The receiving space 30 is formed in a lower part 3*a* of the keycap 3. The two hooking parts 31 are disposed within the receiving space 30. In addition, each of the hooking parts 31 comprises a first hook 32 and a second hook 33.

Please refer to FIG. 4 again. The first hook 32 comprises two first protrusion blocks 321, 322, and a first engaging recess 320. The first engaging recess 320 is arranged between the two first protrusion blocks 321 and 322. The second hook 33 comprises a second protrusion block 331 and a second engaging recess 330. The second engaging recess 330 is disposed under the second protrusion block 331.

The structure of the scissors-type connecting member 4 will be illustrated as follows. As shown in FIG. 5, the scissors-type connecting member 4 comprises an outer frame 41, an inner frame 42, a lower position-limiting post group 410, and an upper position-limiting post group 420.

Moreover, a pivotal hole 44 is located at a middle of an inner surface of the outer frame 41. A shaft 43 is located at a middle of an outer surface of the inner frame 42. The shaft 43 is inserted into the pivotal hole 44. Consequently, the inner frame 42 is pivotally coupled with the outer frame 41, and the inner frame 42 is rotatable relative to the outer frame 41.

Furthermore, the shaft 43 has a planar surface 431. A slant surface 432 is located at an edge of an upper part of the planar surface 431. A position-limiting part 441 is formed on an inner wall of the pivotal hole 44. Due to the slant surface 432, the shaft 43 can be inserted into the pivotal hole 44 more easily. Moreover, the interference between the position-limiting part 441 and the planar surface 431 may limit a rotating degree of the inner frame 42 relative to the outer frame 41.

Moreover, the lower position-limiting post group 410 comprises lower position-limiting posts 411 and 412. The lower position-limiting posts 411 and 412 are protruded from an inner surface of a lower part of the outer frame 41 and an outer surface of a lower part of the inner frame 42, respectively. The upper position-limiting post group 420 comprises upper position-limiting posts 421 and 422. The upper position-limiting posts 421 and 422 are protruded from an outer surface of an upper part of the outer frame 41 and an inner surface of an upper part of the inner frame 42.

Figure 6:
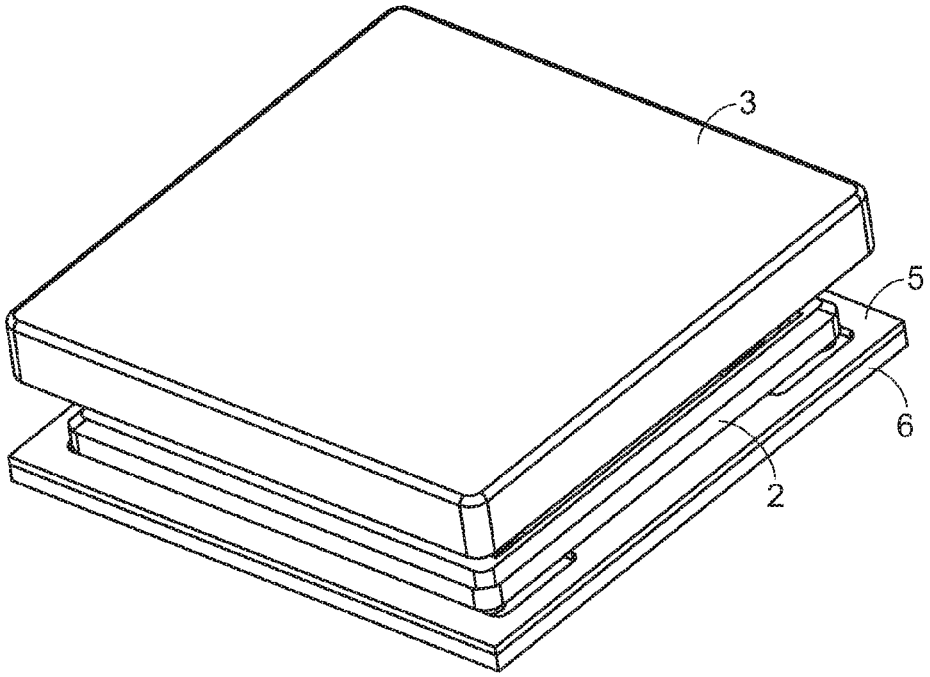
FIG. 6 is a schematic perspective view illustrating a combination of a key structure and a base plate of a keyboard according to an embodiment of the present invention.
Figure 7:
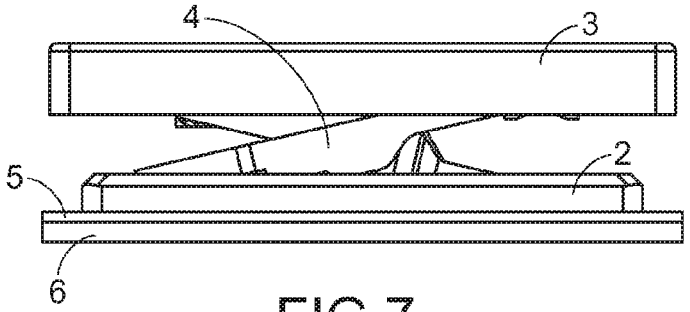
FIG. 7 is a schematic side view illustrating the combination of the key structure and the base plate of the keyboard as shown in FIG. 6.
Figure 8:
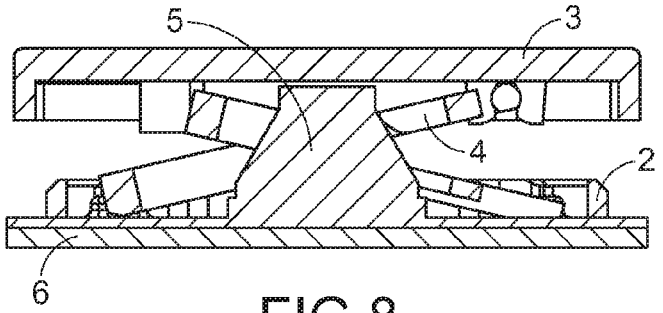
FIG. 8 is a schematic cross-sectional view illustrating the combination of the key structure and the base plate of the keyboard as shown in FIG. 6.

Hereinafter, a process of assembling the key structure of the keyboard of the present invention will be illustrated with reference to FIGS. 2-8. FIG. 6 is a schematic perspective view illustrating a combination of a key structure and a base plate of a keyboard according to an embodiment of the present invention. FIG. 7 is a schematic side view illustrating the combination of the key structure and the base plate of the keyboard as shown in FIG. 6. FIG. 8 is a schematic cross-sectional view illustrating the combination of the key structure and the base plate of the keyboard as shown in FIG. 6.

Firstly, the lower position-limiting posts 411 of the outer frame 41 are inserted into the two position-limiting recesses 22 at a first side of the hollow portion 21 of the intermediate plate 2, respectively. In addition, the lower position-limiting posts 412 of the inner frame 42 are inserted into the two position-limiting recesses 22 at a second side of the hollow portion 21 of the intermediate plate 2, respectively.

After the lower position-limiting posts 411 and 412 of the scissors-type connecting member 4 are accommodated within the corresponding position-limiting recesses 22, the lower position-limiting posts 411 and the 412 are stopped by an upper part 25 of the intermediate plate 2. Under this circumstance, the lower position-limiting posts 411 and 412 fail to be easily detached from the intermediate plate 2.

Then, the upper position-limiting posts 421 of the outer frame 41 are inserted into the two first engaging recesses 320 of the two first hooks 32 of the keycap 3, respectively. In addition, the upper position-limiting posts 422 of the inner frame 42 are inserted into the two second engaging recesses 330 of the two second hooks 33 of the keycap 3, respectively.

Moreover, in this embodiment, the lower position-limiting post 411 has a first planar surface 411*a*, and the lower position-limiting post 412 has a second planar surface 412*a* and a guiding surface 412*b*. The guiding surface 412*b* is inclined to an edge of the second planar surface 412*a*. Due to the guiding surface 412*b*, the lower position-limiting post 412 can be inserted into the corresponding position-limiting recess 22 more easily. The first planar surface 411*a* and the second planar surface 412*a* may limit a rotating degree of the inner frame 42 relative to the outer frame 41. In this embodiment, the upper position-limiting posts 421 and 422 are all cylindrical posts.

Then, the elastic element 5 is fixed on the lower part 24 of the intermediate plate 2, and penetrated through the scissors-type connecting member 4 until the elastic element 5 is contacted with the lower part 3*a* of the keycap 3. Meanwhile, the key structure of the keyboard is assembled.

When the keycap 3 is pressed down, the elastic element 5 is compressed to trigger a switch (not shown) under the elastic element 5. When the pressing force to press down the keycap 3 is eliminated, the elastic element 5 is restored to its original shape. Consequently, the keycap 3 is returned to the original position.

Afterwards, the intermediate plates 2 of plural key structures are fixed on the base plate 6. In particular, the four protrusion posts 23 at the lower part 24 of each intermediate plate 2 are penetrated through corresponding perforations 611 of the base plate 6, respectively. Then, the four protrusion posts 23 are subjected to deformation by performing a hot melt process, so that the deformed protrusion posts 23 are filled in the tapered slots 612 underlying corresponding perforations 611. After the protrusion posts 23 are cooled down and solidified, the intermediate plate 2 is fixed on the base plate 6. Under this circumstance, the key structures and the base plate 6 are combined as a keyboard.

From the above descriptions, the present invention provides a key structure of a keyboard. The key structure comprises an intermediate plate, a keycap, a scissors-type connecting member, and an elastic element. The size of the intermediate plate matches the size of the keycap. The lower position-limiting posts of the scissors-type connecting member are fixed on the intermediate plate. Consequently, the intermediate plate, the keycap, the scissors-type connecting member and the elastic element are combined as a single key structure. After plural key structures are fixed on a base plate, a keyboard is assembled.

The key structure of the present invention is advantageous over the conventional key structure. For example, according to the present invention, the process of forming the intermediate plate is simplified, the molds of the key structure are cost-effective, and the key structure is easily assembled. Moreover, if the position-limiting recess of one intermediate plate is damaged, it is satisfactory to only replace the damaged intermediate plate with a new one. Consequently, the use of the key structure of the present invention is convenient and cost-effective.

Moreover, in the key structure of the present invention, the lower position-limiting posts of the scissors-type connecting member are accommodated within corresponding position-limiting recesses of the intermediate plate. In comparison with the conventional key structure, the process of assembling the key structure of the present invention is simplified. In other words, the key structure of the present invention can be assembled at a faster rate. In a case that an erroneous condition is found after the scissors-type connecting member is assembled, the user can detach the scissors-type connecting member from the intermediate plate without difficulty. Consequently, the key structure of the present invention can be easily assembled, disassembled or replaced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A key structure of a keyboard, said key structure comprising:

a base plate for supporting plural key structures;

an intermediate plate comprising a hollow portion and a position-limiting recess, wherein said position-limiting recess is located near a corner of said hollow portion, wherein said intermediate plate further comprises a protrusion post, wherein said protrusion post is protruded from a lower part of said intermediate plate, and said protrusion post is perpendicular to said lower part of said intermediate plate, wherein said intermediate plate is fixed on said base plate, wherein a perforation corresponding to said protrusion post of said intermediate plate is formed in a top surface of said base plate, and a tapered slot is formed in a bottom surface of said base plate, wherein said perforation and said tapered slot are in communication with each other and collaboratively defined as a trumpet-shaped positioning hole, wherein said protrusion post of said intermediate plate is embedded within said perforation and fixed on said base plate by a heat melt process;

a keycap disposed over said intermediate plate, and comprising a hooking part, wherein said hooking part is located at a lower part of said keycap;

a scissors-type connecting member arranged between said intermediate plate and said keycap, and comprising a lower position-limiting post group and an upper position-limiting post group, wherein said lower position-limiting post group is accommodated within said position-limiting recess of said intermediate plate, and said upper position-limiting post group is accommodated within said hooking part of said keycap; and an elastic element having a peripheral portion fixed on a lower part of said intermediate plate, and a central portion of said elastic element is penetrated through said scissors-type connecting member and contacted with said lower part of said keycap.

2. The key structure according to claim 1, wherein said position-limiting recess is formed in a lower part of said intermediate plate, and said position-limiting recess is in communication with said hollow portion.

3. The key structure according to claim 1, wherein said scissors-type connecting member comprises an outer frame and an inner frame pivotally coupled with said outer frame, wherein said lower position-limiting post group comprises two lower position-limiting posts, which are respectively protruded from a lower part of said outer frame and a lower part of said inner frame, wherein said upper position-limiting post group comprises two upper position-limiting posts, which are respectively protruded from an upper part of said outer frame and an upper part of said inner frame.

4. The key structure according to claim 3, wherein said lower position-limiting post protruded from said lower part of said outer frame has a first planar surface, and said lower position-limiting post protruded from said lower part of said inner frame has a second planar surface and a guiding surface, wherein said guiding surface is inclined to an edge of said second planar surface, and said two upper position-limiting posts are both cylindrical posts.

5. The key structure according to claim 1, wherein said keycap further comprises a receiving space, which is formed in said lower part of said keycap, the hooking part is disposed within the receiving space, wherein said hooking part comprises a first hook and a second hook.

6. A key structure of a keyboard, said key structure comprising:

an intermediate plate comprising a hollow portion and a position-limiting recess, wherein said position-limiting recess is located near a corner of said hollow portion, wherein said position-limiting recess is formed in a lower part of said intermediate plate, and said position-limiting recess is in communication with said hollow portion;

a keycap disposed over said intermediate plate, and comprising a hooking part, wherein said hooking part is located at a lower part of said keycap;

a scissors-type connecting member arranged between said intermediate plate and said keycap, and comprising a lower position-limiting post group and an upper position-limiting post group, wherein said lower position-limiting post group is accommodated within said position-limiting recess of said intermediate plate, and said upper position-limiting post group is accommodated within said hooking part of said keycap; and an elastic element having a peripheral portion fixed on a lower part of said intermediate plate, and a central portion of said elastic element is penetrated through said scissors-type connecting member and contacted with said lower part of said keycap.

7. The key structure according to claim 6, wherein said scissors-type connecting member comprises an outer frame and an inner frame pivotally coupled with said outer frame, wherein said lower position-limiting post group comprises two lower position-limiting posts, which are respectively protruded from a lower part of said outer frame and a lower part of said inner frame, wherein said upper position-limiting post group comprises two upper position-limiting posts, which are respectively protruded from an upper part of said outer frame and an upper part of said inner frame.

8. The key structure according to claim 7, wherein said lower position-limiting post protruded from said lower part of said outer frame has a first planar surface, and said lower position-limiting post protruded from said lower part of said inner frame has a second planar surface and a guiding surface, wherein said guiding surface is inclined to an edge of said second planar surface, and said two upper position-limiting posts are both cylindrical posts.

9. The key structure according to claim 6, wherein said keycap further comprises a receiving space, which is formed in said lower part of said keycap, the hooking part is disposed within the receiving space, wherein said hooking part comprises a first hook and a second hook.

10. A key structure of a keyboard, said key structure comprising:

an intermediate plate comprising a hollow portion and a position-limiting recess, wherein said position-limiting recess is located near a corner of said hollow portion;

a keycap disposed over said intermediate plate, and comprising a hooking part, wherein said hooking part is located at a lower part of said keycap;

a scissors-type connecting member arranged between said intermediate plate and said keycap, and comprising a lower position-limiting post group and an upper position-limiting post group, wherein said lower position-limiting post group is accommodated within said position-limiting recess of said intermediate plate, and said upper position-limiting post group is accommodated within said hooking part of said keycap, wherein said scissors-type connecting member comprises an outer frame and an inner frame pivotally coupled with said outer frame, wherein said lower position-limiting post group comprises two lower position-limiting posts, which are respectively protruded from a lower part of said outer frame and a lower part of said inner frame, wherein said upper position-limiting post group comprises two upper position-limiting posts, which are respectively protruded from an upper part of said outer frame and an upper part of said inner frame, wherein said lower position-limiting post protruded from said lower part of said outer frame has a first planar surface, and said lower position-limiting post protruded from said lower part of said inner frame has a second planar surface and a guiding surface, wherein said guiding surface is inclined to an edge of said second planar surface, and said two upper position-limiting posts are both cylindrical posts; and an elastic element having a peripheral portion fixed on a lower part of said intermediate plate, and a central portion of said elastic element is penetrated through said scissors-type connecting member and contacted with said lower part of said keycap.

11. The key structure according to claim 10, wherein said keycap further comprises a receiving space, which is formed in said lower part of said keycap, the hooking part is disposed within the receiving space, wherein said hooking part comprises a first hook and a second hook.

* * * * *